US009802430B2

(12) United States Patent
Igawa

(10) Patent No.: US 9,802,430 B2
(45) Date of Patent: Oct. 31, 2017

(54) INK DISCHARGE UNIT AND UNIT ASSEMBLING METHOD

(71) Applicant: MIMAKI ENGINEERING CO., LTD., Nagano (JP)

(72) Inventor: Tomomi Igawa, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/241,087

(22) Filed: Aug. 19, 2016

(65) Prior Publication Data

US 2017/0050453 A1 Feb. 23, 2017

(30) Foreign Application Priority Data

Aug. 21, 2015 (JP) ..... 2015-163659

(51) Int. Cl.

| | |
|---|---|
| ***B41J 25/00*** | (2006.01) |
| ***B41J 2/145*** | (2006.01) |
| ***B41J 2/165*** | (2006.01) |
| ***B41J 25/34*** | (2006.01) |

(52) U.S. Cl.

CPC ..... *B41J 25/001* (2013.01); *B41J 2/145* (2013.01); *B41J 2/165* (2013.01); *B41J 2/16579* (2013.01); *B41J 25/34* (2013.01)

(58) Field of Classification Search

CPC ..... B41J 11/008; B41J 25/001; B41J 25/304; B41J 25/308; B41J 25/3082; B41J 25/3086; B41J 19/005

See application file for complete search history.

(56) References Cited

U.S. PATENT DOCUMENTS 5,861,726 A * 1/1999 Uchikata ..... B41J 19/202 318/603

FOREIGN PATENT DOCUMENTS

JP 2003127390 5/2003

* cited by examiner

*Primary Examiner* — Juanita D Jackson
(74) *Attorney, Agent, or Firm* — JCIPRNET

(57) ABSTRACT

The ink discharge unit includes a biasing member. The biasing member is fixed to a fixing member immovably fitted to a carriage body that moves relative to a recording medium. The biasing member, while being thus fixed, biases an inkjet head in a direction illustrated with an arrow and in a direction illustrated with another arrow for position alignment of the inkjet head relative to the fixing member. The inkjet head, while being biased by the biasing member, is fixed to the fixing member. The fixing member has curved portions that regulate movements of the inkjet head in the directions illustrated with the arrows by way of contacts with the inkjet head.

11 Claims, 12 Drawing Sheets

INK DISCHARGE UNIT AND UNIT ASSEMBLING METHOD

CROSS REFERENCE TO RELATED APPLICATIONS

This application claims the priority benefit of Japanese Patent Application No. 2015-163659, filed on Aug. 21, 2015. The entirety of the above-mentioned patent application is hereby incorporated by reference herein and made a part of this specification.

TECHNICAL FIELD

This disclosure relates to an ink discharge unit having an ink jet head mounted in a carriage that moves relative to a recording medium, and a unit assembling method.

DESCRIPTION OF THE BACKGROUND ART

Conventionally, some of the known ink discharge units are equipped with ink jet heads for discharging inks toward a recording medium, and a carriage mounted with the ink jet heads and configured to move relative to the recording medium (for example, Patent Literature 1: JP 2003-127390 A). The carriage of the ink discharge units described in JP 2003-127390 A has a body, and fixing members fixable to the body. The ink discharge unit described in JP 2003-127390 A has ink jet heads and fixing members. An assembling tool used to assemble the ink jet head and the fixing member includes a pair of fitting pins, and a substantially "L"-shaped locating portion. The fitting pins are positionally located relative to the fixing member and fitted to the fixing member. The locating portion receives two edge surfaces of the cubical ink jet head pushed against it. Describing in further detail the ink jet head and the fixing member of the ink discharge unit described in JP 2003-127390 A, two edge surfaces of the cubical ink jet head are pushed against the substantially "L"-shaped locating portion of the assembling tool, with the fitting pins of the assembling tool being fitted to the fixing member. After the ink jet head is thereby positionally located relative to the fixing member, the ink jet head is fixed to the fixing member.

Patent Literature 1: JP 2003-127390 A

SUMMARY

In the ink discharge unit described in JP 2003-127390 A, an operator, while trying to fix the ink jet head to the fixing member, needs to manually push the two edge surfaces of the cubical ink jet head against the substantially "L"-shaped locating portion of the assembling tool. Such an assembling work requires difficult handling. In the ink discharge unit described in JP 2003-127390 A thus requiring an operator, who tries to fix the ink jet head to the fixing member, to support with his hands the two edge surfaces of the cubical ink jet head pushed against the substantially "L"-shaped locating portion of the assembling tool, it may be difficult to accurately position the ink jet head relative to the fixing member.

This disclosure is directed to providing an ink discharge unit and a unit assembling method that may accurately position ink jet heads in a carriage and provide for a facilitated assembling work as compared to the known techniques.

An ink discharge unit disclosed herein includes: an ink jet head that discharges an ink toward a recording medium; a carriage that moves relative to the recording medium; and a biasing member that biases the ink jet head mounted in the carriage for position alignment of the ink jet head relative to the carriage. The carriage has a carriage-side contact portion that makes contact with the ink jet head in an orthogonal direction orthogonal to a direction in which ink is discharged from the ink jet head mounted in the carriage. The biasing member biases the ink jet head in a pushing direction included in the orthogonal direction in which the ink jet head is pushed against the carriage-side contact portion. The carriage-side contact portion regulates, by way of contact with the ink jet head, movements of the ink jet head in at least two directions that includes the pushing direction included in the orthogonal direction.

The ink discharge unit thus positionally locates the ink jet head in the carriage by lever aging the biasing force of the biasing member, instead of an operator's handwork. This may allow the ink jet head to be very accurately positioned in the carriage. Specifically, the ink discharge unit is structured to bias the ink jet head using the biasing member for position alignment of the ink jet head relative to the carriage and to regulate movements of the ink jet head in at least two directions using the carriage-side contact portion of the carriage. This structural feature of the ink discharge unit may ensure high accuracy in positioning the ink jet head in the carriage. In the ink discharge unit disclosed herein, the ink jet head, with its position in the carriage being supported by the biasing force of the biasing member, is mounted in the carriage. At the time of mounting the ink jet head in the carriage, an operator's handwork is unnecessary to support the position of the ink jet head in the carriage, facilitating the assembling work as compared to the known techniques.

The ink discharge unit disclosed herein may be further characterized in that the carriage has a body, and a fixing member fixable to the body, the biasing member, while being fitted to the fixing member, biases the ink jet head for position alignment of the ink jet head relative to the fixing member, and the carriage-side contact portion is disposed in the fixing member.

In the ink discharge unit described above, the body of the carriage and the fixing member to which the ink jet head is to be fitted are thus different members separately provided. Therefore, the ink jet head may be very accurately positioned in the carriage body by adjusting the position of the fixing member relative to the carriage body.

The ink discharge unit disclosed herein may be further characterized in that the biasing member has a pushing direction biasing portion that biases the ink jet head in the pushing direction, and a different direction biasing portion that biases the ink jet head in at least a direction included in the orthogonal direction other than the pushing direction.

The ink discharge unit is thus structured to bias the ink jet head in at least two directions using the biasing member for position alignment of the ink jet head relative to the fixing member and to regulate movements of the ink jet head in at least two directions using the carriage-side contact portion of the fixing member. This structural feature of the ink discharge unit may ensure high accuracy in positioning the ink jet head relative to the fixing member.

The ink discharge unit disclosed herein may be further characterized in that the different direction biasing portion has a first biasing portion and a second biasing portion disposed at opposing positions, the first biasing portion and the second biasing portion bias the ink jet head toward each other to hold the ink jet head therebetween, and the first biasing portion and the second biasing portion bias the ink jet head in a direction included in the orthogonal direction and orthogonal to the pushing direction.

The ink discharge unit is thus structured to push the ink jet head in the pushing direction using the pushing direction biasing portion of the biasing member and to bias the ink jet head in a direction orthogonal to the pushing direction using the different direction biasing portion of the biasing member to hold the ink jet head therebetween. This structural feature of the ink discharge unit may allow the position of the ink jet head in the carriage to be better supported by the biasing force of the biasing member. At the time of mounting the ink jet head in the carriage, therefore, the ink discharge unit may further improve the accuracy of positioning the ink jet head in the carriage.

The ink discharge unit disclosed herein may be further characterized in that the first biasing portion and the second biasing portion each have a guiding member, and the guiding members, while holding the ink jet head therebetween, guide the ink jet head to a predetermined position in the carriage.

The ink discharge unit thus guides the ink jet head to a predetermined position in the carriage using the guiding members when the ink jet head is moved to be biased by the biasing member. As a result, the ink jet head may be manually positioned in the carriage more accurately and more easily.

The ink discharge unit disclosed herein may be further characterized in that the ink jet head has a head-side contact portion that makes contact with the carriage-side contact portion in the orthogonal direction, one of the carriage-side contact portion and the head-side contact portion has a convex surface, the other one of the carriage-side contact portion and the head-side contact portion has a concave surface, and the convex surface has a greater curvature than the concave surface.

In the ink discharge unit thus characterized, the convex surface greater in curvature than the concave surface may certainly be brought into close contact with the concave surface. In the ink discharge unit, movements of the ink jet head by the carriage in at least two directions may be regulated by way of such a simplified structure.

A unit assembling method disclosed herein assembles an ink discharge unit. The ink discharge unit includes: an ink jet head that discharges an ink toward a recording medium; a body; a fixing member fixable to the body; a carriage that moves relative to the recording medium; and a biasing member that, while being fitted to the fixing member, biases the ink jet head for position alignment of the ink jet head relative to the fixing member. In this method, the ink jet head, while being biased by the biasing member fitted to the fixing member, is fitted to the fixing member, position alignment of the ink jet head relative to the body is then performed, and the fixing member is fixed to the body while the ink jet head is being positionally aligned relative to the body.

The unit assembling method thus supports the position of the ink jet head relative to the fixing member by lever aging the biasing force of the biasing member, instead of an operator's handwork. This may allow the ink jet head to be very accurately positioned relative to the fixing member. In the unit assembling method described above, the ink jet head, with its position relative to the fixing member being supported by the biasing force of the biasing member, is fitted to the fixing member. At the time of fitting the ink jet head to the fixing member, an operator's handwork is unnecessary to support the position of the ink jet head relative to the fixing member, facilitating the assembling work as compared to the known techniques. The unit assembling method, after the ink jet head is fitted to the fixing member, positionally aligns the ink jet head relative to the body of the carriage and fixes the fixing member to the body of the carriage. In case the ink jet head is removed from the fixing member after the fixing member is fixed to the body of the carriage and a new ink jet head is then fitted to the fixing member, the ink jet head newly fitted to the fixing member may be very accurately positioned by the biasing member relative to the body of the carriage. When the ink jet head once removed from the body of the carriage is fitted back to the body of the carriage, the unit assembling method may very accurately position the ink jet head relative to the body of the carriage. The unit assembling method may also facilitate and accelerate the assembling work as compared to the known techniques.

In the unit assembling method, the ink jet head removed from the fixing member fixed to the body may optionally be refitted to the fixing member while the ink jet head is being biased by the biasing member fitted to the fixing member.

The unit assembling method, after the ink jet head is fitted to the fixing member, positionally aligns the ink jet head relative to the body of the carriage and fixes the fixing member to the body of the carriage. In case the ink jet head is removed from the fixing member after the fixing member is fixed to the body of the carriage and a new ink jet head is then fitted to the fixing member, the ink jet head newly fitted to the fixing member may be very accurately positioned by the biasing member relative to the body of the carriage. Therefore, when the ink jet head once removed from the body of the carriage is fitted back to the body of the carriage, the unit assembling method disclosed herein may very accurately position the ink jet head relative to the body of the carriage. The unit assembling method may also facilitate and accelerate the assembling work as compared to the conventional techniques.

The ink discharge unit and the unit assembling method disclosed herein may successfully position ink jet heads in a carriage with high accuracy and provide for a facilitated assembling work as compared to the conventional techniques.

DETAILED DESCRIPTION OF EMBODIMENTS

An embodiment of this disclosure is hereinafter described referring to the accompanying drawings.

The description given below starts with the structure of an ink jet printer according to the embodiment.

Figure 1:
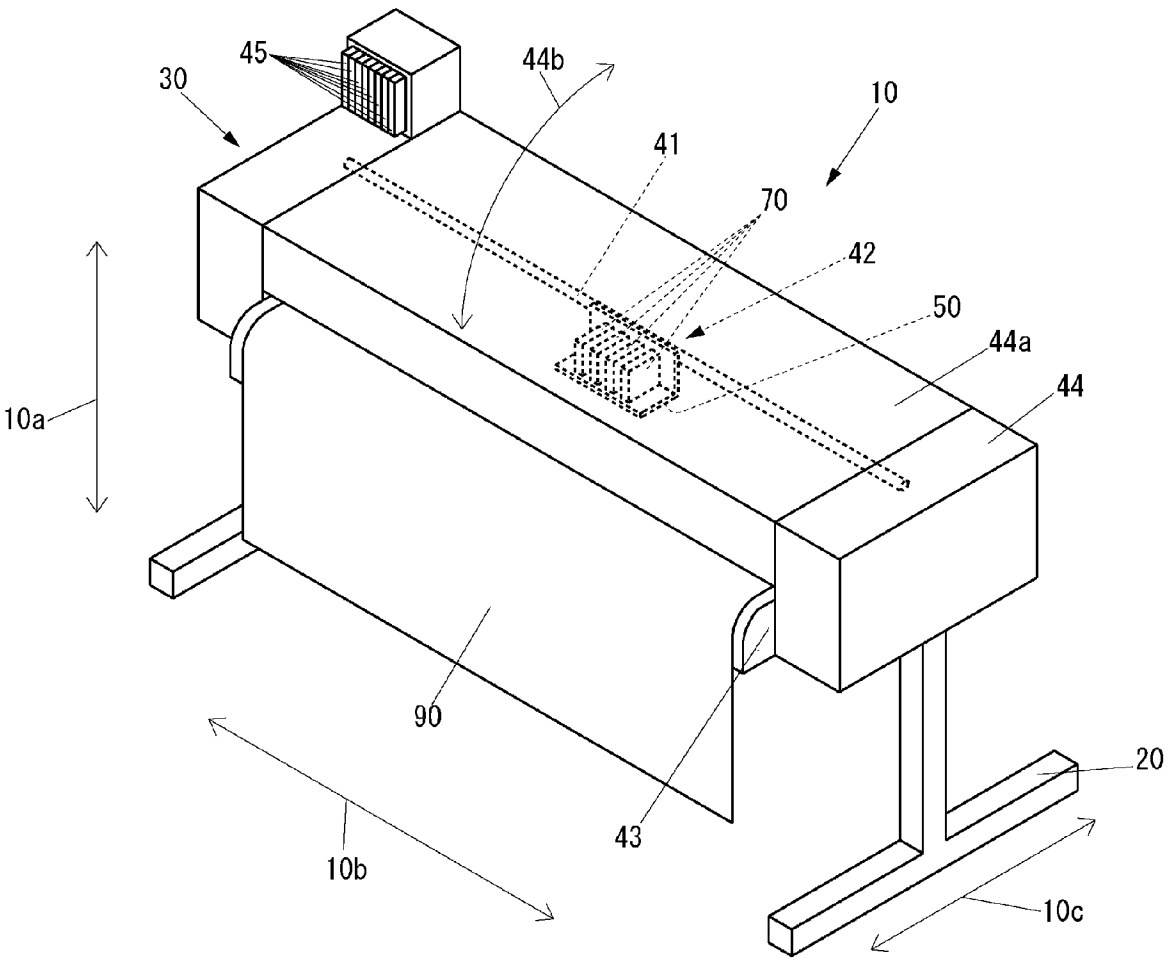
FIG. 1 is a front, upper-right perspective view of the external appearance of an ink jet printer according to an embodiment of this disclosure.

FIG. 1 is a front, upper-right perspective view of the external appearance of an ink jet printer 10 according to the embodiment.

As illustrated in FIG. 1, the ink jet printer 10 has legs 20 placed on a floor, and a printer body 30 disposed on the upper side of the legs 20 in a vertical direction illustrated with an arrow 10*a*. The printer body 30 is supported by the legs 20.

The printer body 30 (see FIG. 1) has a rail 41 extending in a transverse direction illustrated with an arrow 10*b* orthogonal to the vertical direction 10*a*, an ink discharge unit 42 supported by the rail 41 movably in the direction 10*b*, a platen 43 that supports a recording medium 90, a transport mechanism not illustrated in the drawing, a shielding case 44 that shields the rail 41 and the ink discharge unit 42, and a plurality of ink tanks 45 in which inks are stored. The transport mechanism transports the recording medium 90 supported by the platen 43 in a front-back direction illustrated with an arrow 10*c* orthogonal to the directions 10*a* and 10*b*.

The ink discharge unit 42 has a carriage 50 supported by the rail 41 movably in the direction 10*b*, and a plurality of ink jet heads 70 mounted in the carriage 50. The ink jet heads 70 discharge inks in a direction included in the direction 10*a* in which the recording medium 90 is currently present.

The carriage 50 supported by the rail 41 movably in the direction 10*b* is allowed to move relative to the recording medium 90 in the direction 10*b*. The recording medium 90 is transported in the direction 10*c* by the transport mechanism not illustrated in the drawing. The carriage 50 is accordingly allowed to move relative to the recording medium 90 in the direction 10*c*. The carriage 50 is thus allowed to move relative to the recording medium 90 in both of the directions 10*b* and 10*c*.

The shielding case 44 has an openable and closeable cover 44*a*. The cover 44*a* is disposed on the rear-end side of the ink jet printer 10. The cover 44*a* opens and closes in a direction illustrated with an arrow 44*b* around an axis, not illustrated in the drawing, extending in the direction 10*b*. After opening the cover 44*a*, an operator can carry out, on the front side of the ink jet printer 10, maintenances of the ink discharge unit 42.

The ink tanks 45 are respectively connected to the ink jet heads 70 with tubes not illustrated in the drawing to feed the ink jet beads 70 with the inks through the tubes.

Figure 2A:
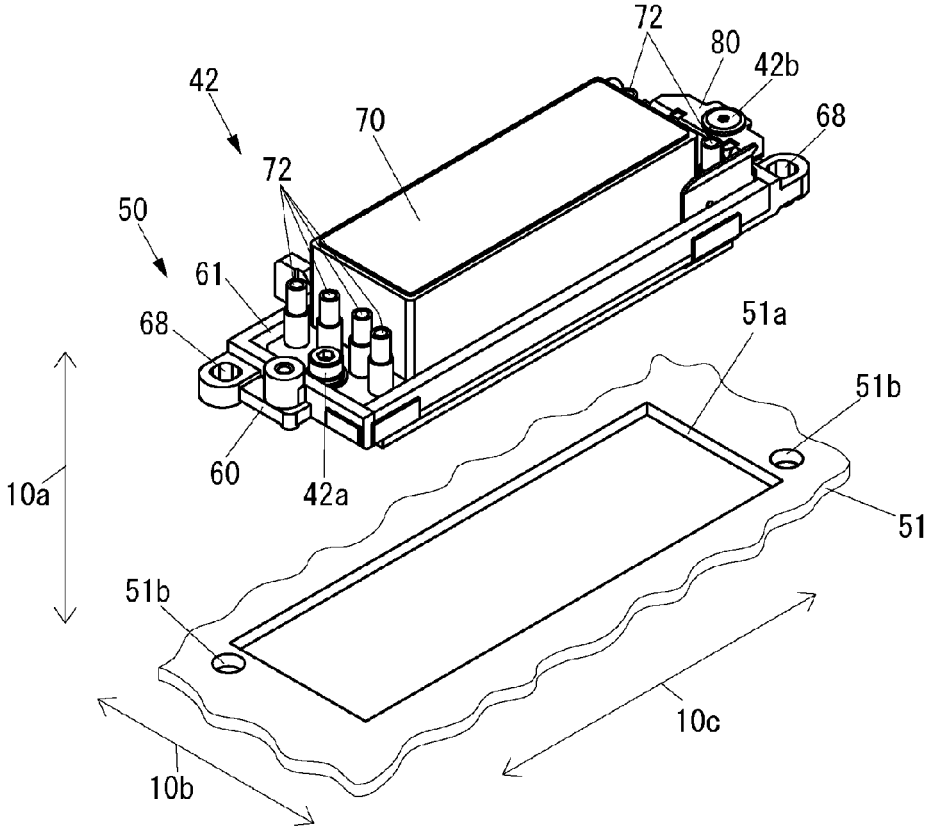
FIG. 2A is a partial front, upper-right perspective view of the external appearance of an ink discharge unit illustrated in FIG. 1 soon to be completed.
Figure 2B:
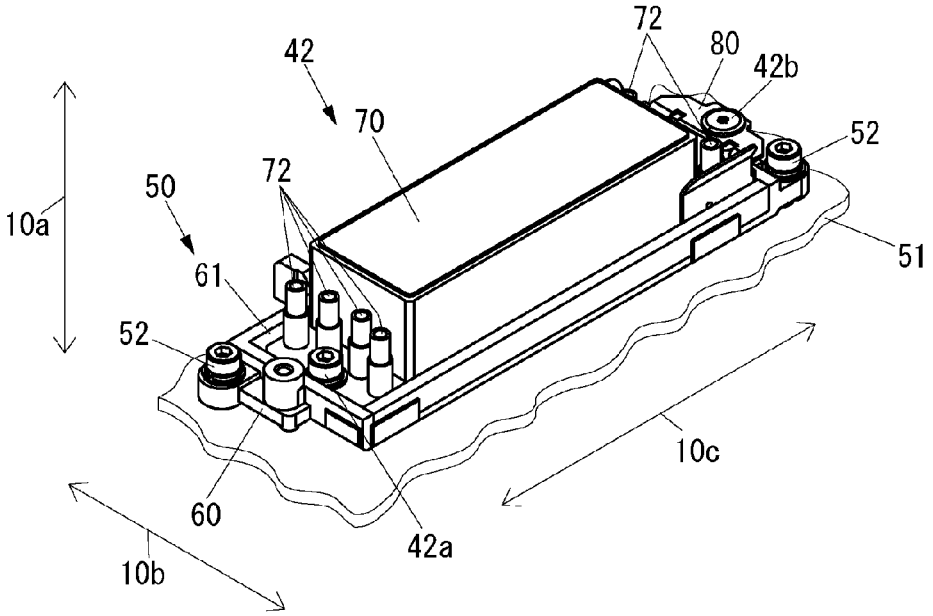
FIG. 2B is a partial front, upper-right perspective view of the external appearance of the ink discharge unit illustrated in FIG. 1 already completed.

FIG. 2A is a partial front, upper-right perspective view of the external appearance of the ink discharge unit 42 soon to be completed. FIG. 2B is a partial front, upper-right perspective view of the external appearance of the ink discharge unit 42 already completed.

Referring to FIGS. 2A and 2B, the ink discharge unit 42 has the carriage 50, the ink jet head 70, a biasing member 80 made of, for example, a stainless steel and serving to bias the ink jet head 70 for position alignment of the ink jet head 70 relative to the carriage 50, bolts 42*a* for fixing the ink jet head 70 to a fixing member 60 described later, and a bolt 42*b* for fixing the biasing member 80 to the fixing member 60. In FIGS. 2A and 2B, one bolt 42*a* on one side of the ink jet head 70 in the direction 10*c* is visually recognizable. However, there are bolts 42*a* on both sides of the ink jet head 70 in the direction 10*c*.

The carriage 50 has a body 51 (hereinafter, "carriage body"), and fixing members 60 fixed with bolts 52 to the carriage body 51.

The carriage body 51 has cavities 51*a* at respective positions corresponding to the ink jet heads 70. The carriage body 51 has two threaded holes 51*b* for each of the cavities 51*a*. The threaded holes 51*b* receive the bolts 52 immovably fitted therein.

The fixing member 60 is partly inserted in the cavity 51*a* of the carriage body 51 and then fixed to the carriage body 51 with the bolts 52.

Figure 3A:
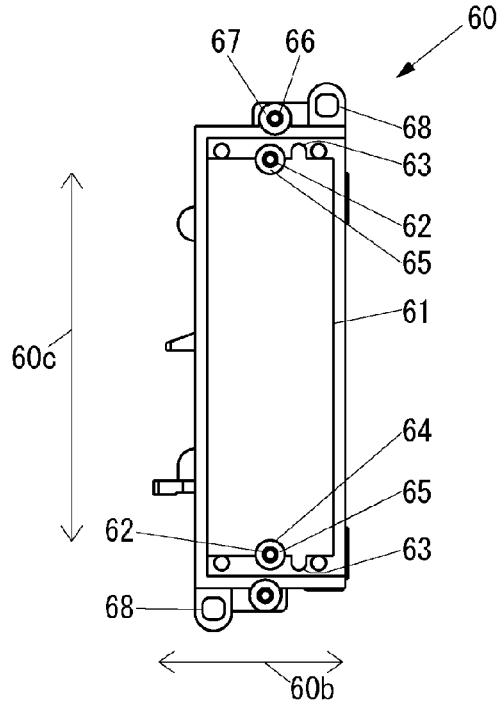
FIG. 3A is a plan view of a fixing member illustrated in FIGS. 2A and 2B.
Figure 3B:
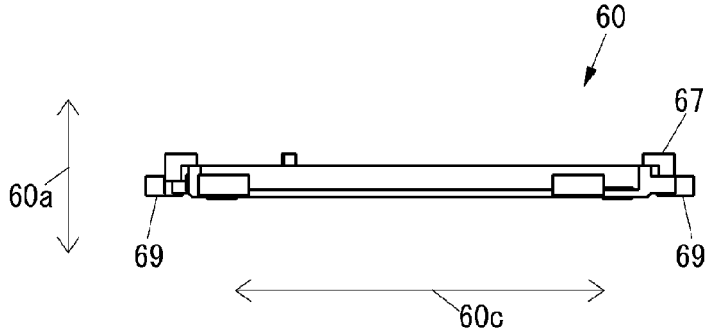
FIG. 3B is a right-side view of the fixing member illustrated in FIGS. 2A and 2B.
Figure 3C:
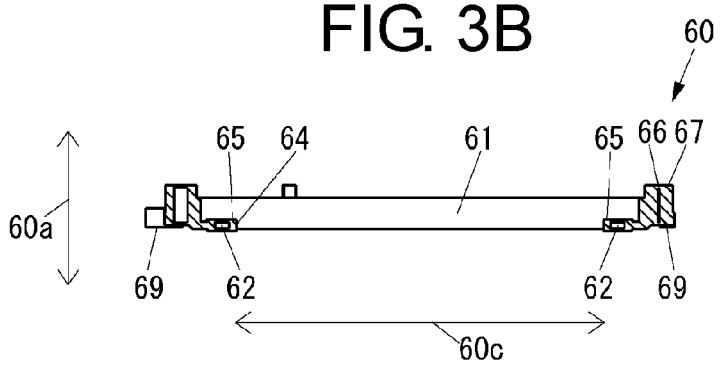
FIG. 3C is a right-side view in cross section of the fixing member illustrated in FIGS. 2A and 2B.

FIG. 3A is a plan view of the fixing member 60. FIG. 3B is a right-side view of the fixing member 60. FIG. 3C is a right-side view in cross section of the fixing member 60.

Referring to FIGS. 3A to 3C, a direction illustrated with an arrow 60*a*, a direction illustrated with an arrow 60*b*, and a direction illustrated with an arrow 60*c* are orthogonal to one another. After the fixing member 60 is fixed to the carriage body 51 (see FIG. 2B), the direction 60*a*, direction 60*b*, and direction 60*c* respectively coincide with the direction 10*a* (see FIG. 2B), direction 10*b* (see FIG. 2B), and direction 10*c* (see FIG. 2B).

The fixing member 60 has a rectangular cavity 61. A part of the ink jet head 70 (see FIGS. 2A and 2B) including its nozzle surface 71 (see FIGS. 4A to 4C) is to be inserted in the cavity 71.

The fixing member 60 has one threaded hole 62 on each of both end sides thereof in the direction 60*c*. The bolts 42*a* (see FIGS. 2A and 2B), used to fix the ink jet head 70 to the fixing member 60, are to be immovably fitted in the threaded holes 62.

The fixing member 60 has one notch 63 on each of both end sides thereof in the direction 60*c*. Pins 74 (see FIGS. 4A to 4C) of the ink jet head 70, described later, are to be inserted in the notches 63. The two notches 63 are formed at positions displaced from the center of the cavity 61 toward an end side thereof in the direction 60*b*.

The fixing member 60 has a curved portion 64 as a carriage-side contact portion on one end side thereof in the direction 60*c*. The curved portion 64 contacts a curved portion 75 of the ink jet head 70 described later (see FIGS. 4A to 4C) in a direction orthogonal to the direction 60*a*. The curved portion 64 has a convex surface projecting toward the other end side of the fixing member 60 in the direction 60*c*. The convex surface of the curved portion 64 has a greater curvature than the concave surface of the curved portion 75. The curved portion 64 is formed by a partial side surface of a columnar portion having the threaded hole 62 formed at its center.

The fixing member 60 has one planar portion 65 on each of both end sides thereof in the direction 60*c*. The planar portions 65 make contact with planar portions 78 of the ink jet head 70 described later (see FIGS. 5A and 5B) in the direction 60*a*. The planar portions 65 are each formed by one of two bottom surfaces of a columnar portion having the threaded hole 62 formed at its center.

The fixing member 60 has a threaded hole 66 on the opposite side of the curved portion 64 in the direction 60*c*. The bolt 42*b* (see FIGS. 2A and 2B), used to fix the biasing member 80 (see FIGS. 2A and 2B) to the fixing member 60, is to be immovably fitted in the threaded hole 66.

The fixing member 60 further has a planar portion 67 in the direction 60*a*. The planar portion 67 makes contact with the biasing member 80. The planar portion 67 is formed by one of two bottom surfaces of a columnar portion having the threaded hole 66 formed at its center.

The fixing member 60 has one hole 68 on each of both end sides thereof in the direction 60*c*. The bolts 52 (see FIGS. 2A and 2B), used to fix the fixing member 60 to the carriage body 51 (see FIGS. 2A and 2B), are to be inserted in the holes 68.

The fixing member 60 further has one planar portion 69 on each of both end sides thereof in the direction 60*c*. The planar portions 69 serve to contact the carriage body 51 in the direction 60*a*. The holes 68 are formed in the planar portions 69.

Figure 4A:
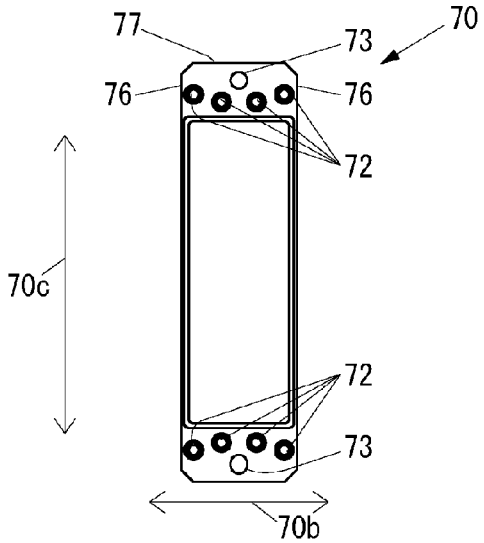
FIG. 4A is a plan view of an ink jet head illustrated in FIGS. 2A and 2B.
Figure 4B:
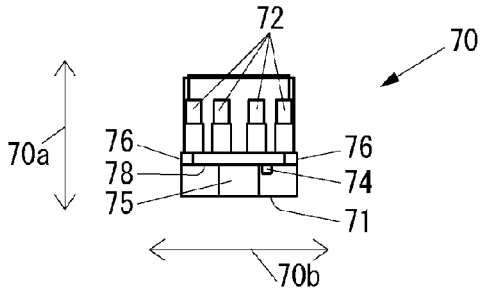
FIG. 4B is a front view of the ink jet head illustrated in FIGS. 2A and 2B.
Figure 4C:
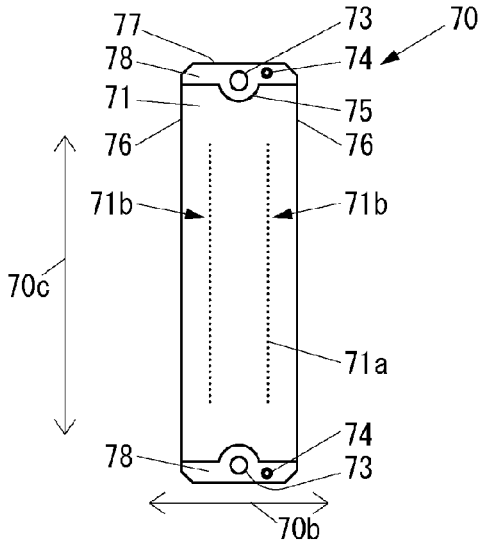
FIG. 4C is a bottom-side view of the ink jet head illustrated in FIGS. 2A and 2B.
Figure 5A:
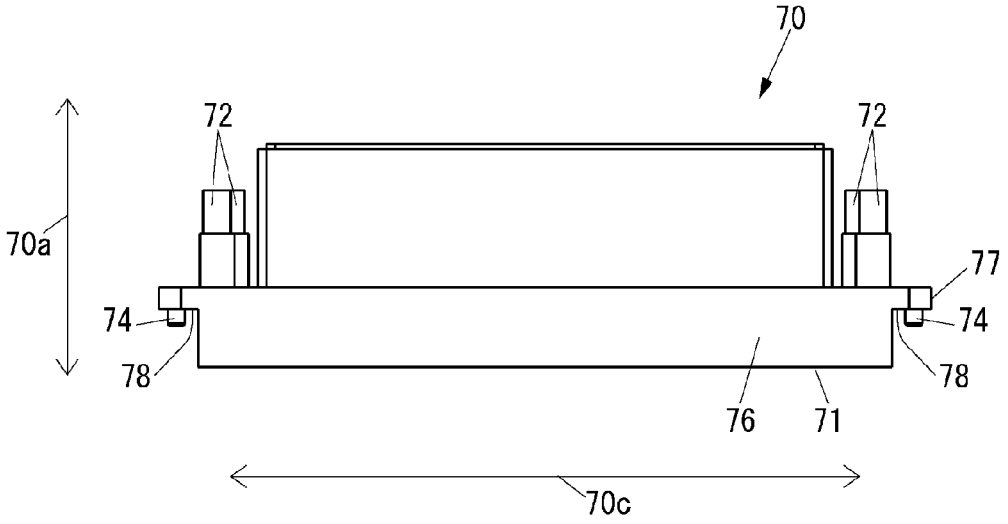
FIG. 5A is a right-side view of the ink jet head illustrated in FIGS. 2A and 2B.
Figure 5B:
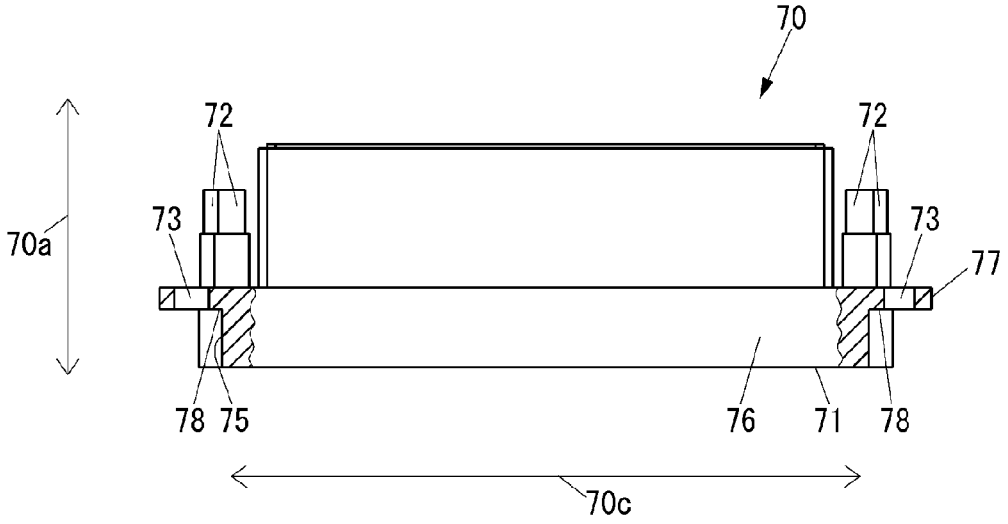
FIG. 5B is a partial right-side view in cross section of the ink jet head illustrated in FIGS. 2A and 2B.

FIG. 4A is a plan view of the ink jet head 70. FIG. 4B is a front view of the ink jet head 70. FIG. 4C is a bottom-side view of the ink jet head 70. FIG. 5A is a right-side view of the ink jet head 70. FIG. 5B is a partial right-side view in cross section of the ink jet head 70.

Referring to FIGS. 4A to 5B, a direction illustrated with an arrow 70*a*, a direction illustrated with an arrow 70*b*, and a direction illustrated with an arrow 70*c* are orthogonal to one another. After the fixing member 60 (see FIG. 2B) with the ink jet head 70 fitted thereto is fixed to the carriage body 51 (see FIG. 2B), the direction 70*a*, direction 70*b*, and direction 70*c* respectively coincide with the direction 10*a* (see FIG. 2B), direction 10*b* (see FIG. 2B), and direction 10*c* (see FIG. 2B).

The ink jet head 70 has a nozzle surface 71 on one end thereof in the direction 70*a*. On the nozzle surface 71, two nozzle arrays 71*b*, each having a large number of ink-discharge nozzles 71*a* arranged in the direction 70*c*, are arranged in the direction 70*b*.

The ink jet head 70 has four tube connecting parts 72 on each of both end sides thereof in the direction 70*c*. Tubes are to be connected to the tube connecting parts 72, through which the inks are supplied from the ink tanks 45 (see FIG. 1).

The ink jet head 70 has one hole 73 on each of both end sides thereof in the direction 70*c*. The bolts 42*a* (see FIGS. 2A and 2B), used to fix the ink jet head 70 to the fixing member 60, are to be inserted in the holes 73.

The ink jet head 70 has one pin 74 on each of both end sides thereof in the direction 70*c*. The pins 74 are used to decide the orientation of the ink jet head 70 relative to the fixing member 60 in a direction of rotation centered on an axis extending in the direction 70*a*. The two pins 74 are formed at positions displaced from the center of the ink jet head 70 toward an end side thereof in the direction 70*b*.

The ink jet head 70 has a curved portion 75 as a head-side contact portion on one end side thereof in the direction 70*c*. The curved portion 75 makes contact with the fixing member 60 in a direction orthogonal to the direction 70*a*. The curved portion 75 has a concave surface dented toward the other end side of the ink jet head in the direction 70*c*.

The ink jet head 70 has one planar portion 76 on each of both end sides thereof in the direction 70*b*. The planar portions 76 contact the biasing member 80 (see FIGS. 2A and 2B) in the direction 70*b*.

The ink jet head 70 has a planar portion 77 on the opposite side of the curved portion 75 in the direction 70*c*. The planar portion 77 makes contact with the biasing member 80 in the direction 70*c*.

The ink jet head 70 has one planar portion 78 on each of both end sides thereof in the direction 70*c*. The planar portions 78 make contact with the fixing member 60 in the direction 70*a*.

Figure 6A:
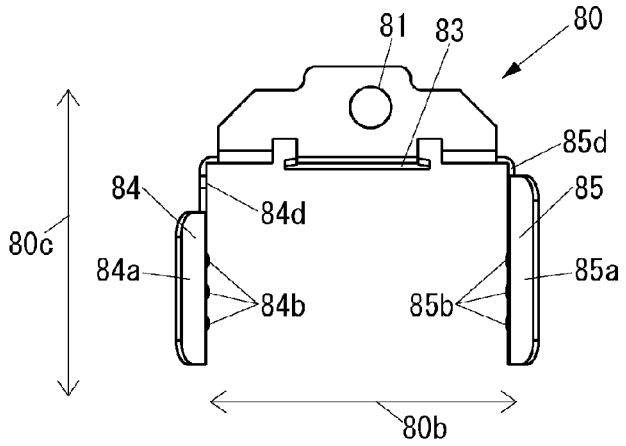
FIG. 6A is a plan view of a biasing member illustrated in FIGS. 2A and 2B.
Figure 6B:
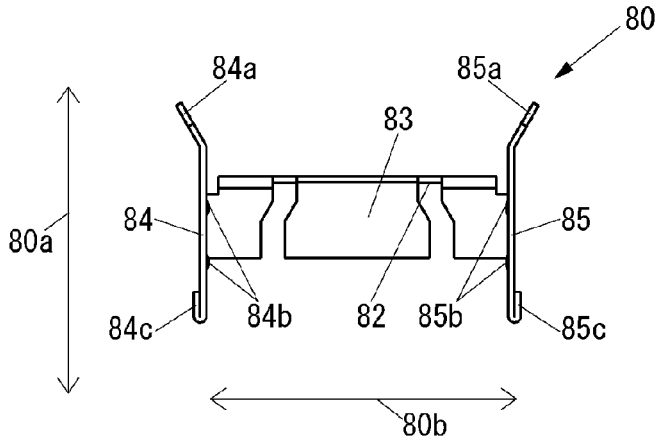
FIG. 6B is a front view of the biasing member illustrated in FIGS. 2A and 2B.
Figure 6C:
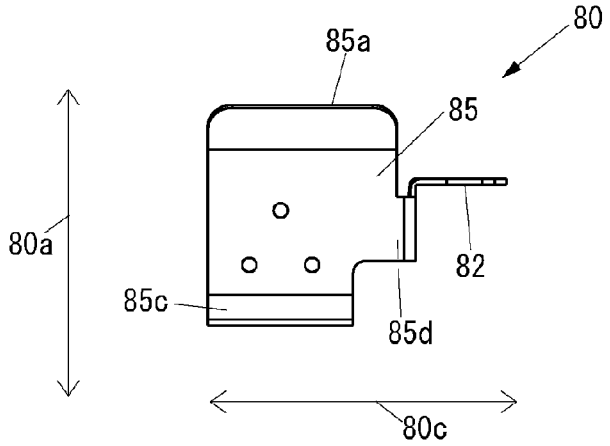
FIG. 6C is a right-side view of a biasing member illustrated in FIGS. 2A and 2B.
Figure 7:
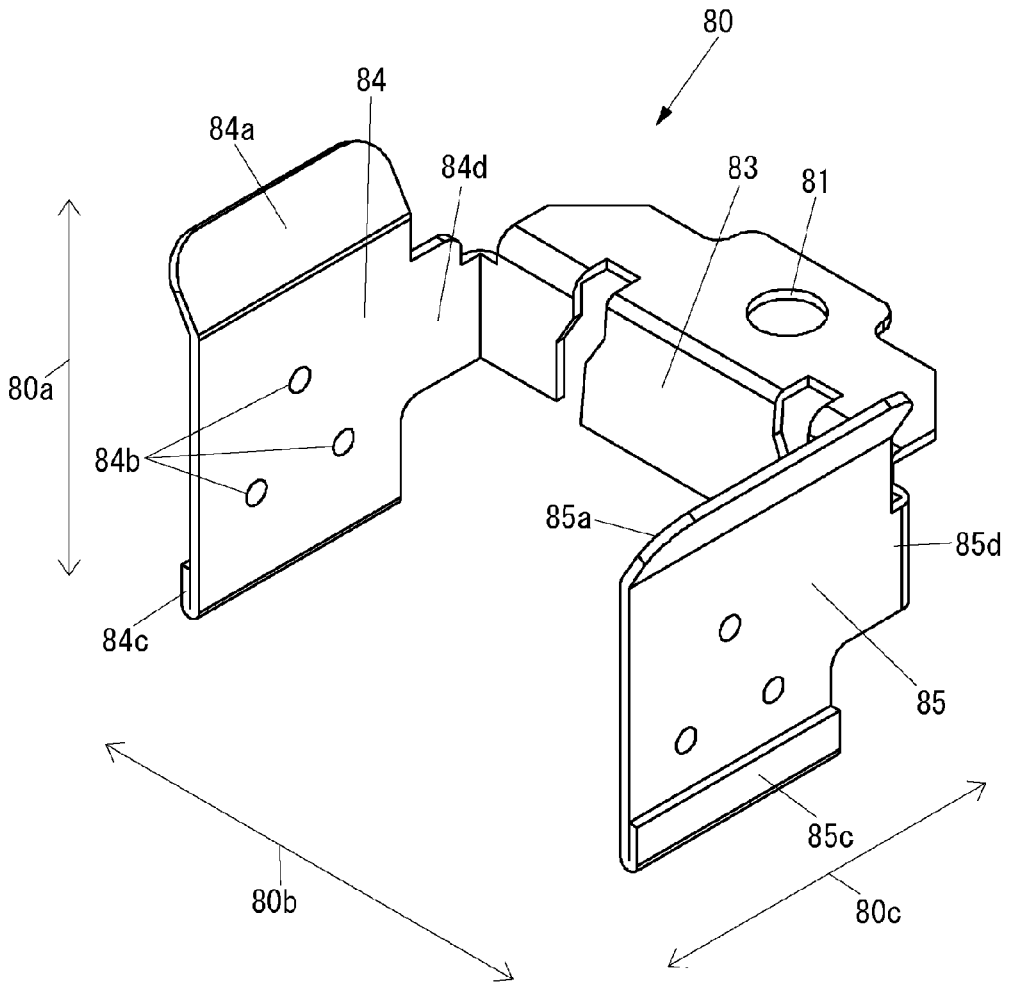
FIG. 7 is a front, upper-right perspective view of the external appearance of the biasing member illustrated in FIGS. 2A and 2B.

FIG. 6A is a plan view of the biasing member 80. FIG. 6B is a front view of the biasing member 80. FIG. 6C is a right-side view of the biasing member 80. FIG. 7 is a front, upper-right perspective view of the external appearance of the biasing member 80.

Referring to FIGS. 6A to 7, a direction illustrated with an arrow 80*a*, a direction illustrated with an arrow 80*b*, and a direction illustrated with an arrow 80*c* are orthogonal to one another. After the fixing member 60 with the biasing member 80 fitted thereto (see FIG. 2B) is fixed to the carriage body 51 (see FIG. 2B), the direction 80*a*, direction 80*b*, and direction 80*c* respectively coincide with the direction 10*a* (see FIG. 2B), direction 10*b* (see FIG. 2B), and direction 10*c* (see FIG. 2B).

The biasing member 80 has a hole 81 on one end side thereof in the direction 80*c*. The hole 81 is formed to have the bolt 42*b* (see FIGS. 2A and 2B), used to fix the biasing member 80 to the fixing member 60, be inserted therein.

The biasing member 80 has one planar portion 82 on one end side thereof in the direction 80*c*. The planar portion 82 makes contact with the planar portion 67 of the fixing member 60 (see FIGS. 3A to 3C) in the direction 80*a*. The planar portion 82 has a hole 81 formed therein.

The biasing member 80 has a biasing portion 83 on one end side thereof in the direction 80*c*. The biasing portion 83 biases the planar portion 77 (see FIGS. 4A to 4C) of the ink jet head 70 (see FIGS. 2A and 2B) toward the other end side in the direction 80*c*. The biasing member 80 biases the ink jet head 70 using the biasing portion 83 in a direction in which the ink jet head 70 is pushed against the curved portion 64 of the fixing member 60 (see FIGS. 3A to 3C). This pushing direction is orthogonal to a direction in which the inks are discharged from the ink jet head 70 mounted in the carriage 50. The biasing portion 83 constitutes the pushing direction biasing portion defined in this disclosure.

The biasing portion 83 is connected to the planar portion 82 on one end side thereof in the direction 80*a* where the biasing portion 83 starts to contact the ink jet head 70 when the ink jet head 70 is brought into contact with the biasing member 80 to be fixed to the fixing member 60. The biasing portion 83, from its one end side toward the other end side thereof in the direction 80*a*, inclines so as to draw nearer to the other end side in the direction 80*c*. The biasing portion 83, when contacting the planar portion 77 of the ink jet head 70, is pushed by the planar portion 77 of the ink jet head 70. The biasing portion 83 thus pushed thereby deforms toward one end side in the direction 80*c* and becomes less inclined. Then, the elastic force of the biasing portion 83, in an attempt to undo the deformation, serves to bias the planar portion 77 of the ink jet head 70 toward the other end side in the direction 80*c*.

The biasing member 80 has a biasing portion 84 on the other end side thereof in the direction 80*b*. The biasing portion 84 biases one of the two planar portions 76 of the ink jet head 70 (see FIGS. 4A to 4C) toward one end side in the direction 80*b*. The biasing member 80 further has a biasing portion 85 on one end side thereof in the direction 80*b*. The biasing portion 85 biases the other one of the two planar portions 76 of the ink jet head 70 toward the other end side in the direction 80*b*. The biasing portions 84 and 85 bias the ink jet head 70 in at least a direction included in the direction orthogonal to the ink-discharge direction of the ink jet head 70 mounted in the carriage 50 other than the pushing direction described earlier. These biasing portions constitute the different direction biasing portion defined in this disclosure. One of the biasing portions 84 and 85 constitutes the first biasing portion, while the other one of these biasing portions constitutes the second biasing portion.

The biasing portion 84 has an inclined part 84*a* as a guiding member three point-like contact parts 84*b*, a reinforcing part 84*c*, and a connecting part 84*d*. The inclined part 84*a*, by contacting the ink jet head 70 when the ink jet head 70 is inserted in between the biasing portions 84 and 85, guides the ink jet head 70 to a predetermined position in the carriage 50 in the direction 80*b*. The contact parts 84*b* protrude toward the biasing portion 85 and contact the planar portion 76 of the ink jet head 70. The reinforcing part 84*c* has a shape bent toward the opposite side of the biasing portion 85. The connecting part 84*d* is connected to the side of the biasing member 80 where the planar portion 82 is disposed. The contact parts 84*b* protrude toward one end side in the direction 80*b*, i.e., toward the biasing portion 85. A distance in the direction 80*b* between the contact parts 84*b* of the biasing portion 84 and contact parts 85*b* of the biasing portion 85 described later is smaller than the width of the ink jet head 70 in the direction 70*b* (see FIGS. 4A to 4C). When the contact parts 84*b* of the biasing portion 84 contact the planar portion 76 of the ink jet head 70, the biasing portion 84 deforms toward the other end side in the direction 80*b* away from the biasing portion 85 in the direction 80*b*. Then, the elastic force of the biasing portion 84, in an attempt to undo the deformation, serves to bias the planar portion 76 of the ink jet head 70 toward one end side in the direction 80*b*. The reinforcing part 84*c* serves to prevent that the portion in the direction 80*c* where the three contact parts 84*b* are formed from deforming in the direction 80*b*.

Likewise, the biasing portion 85 has an inclined part 85*a* as a guiding member three point-like contact parts 85*b*, a reinforcing part 85*c*, and a connecting part 85*d*. The inclined part 85*a*, by contacting the ink jet head 70 when the ink jet head 70 is inserted in between the biasing portions 84 and 85, guides the ink jet head 70 to a predetermined position in the carriage 50 in the direction 80*b*. The contact parts 85*b* protrude toward the biasing portion 84 and contact the planar portion 76 of the ink jet head 70. The reinforcing part 85*c* has a shape bent toward the opposite side of the biasing portion 84. The connecting part 85*d* is connected to the side of the biasing member 80 where the planar portion 82 is disposed. The contact parts 85*b* protrude toward the other end side in the direction 80*b*, i.e., toward the biasing portion 84. A distance in the direction 80*b* between the contact parts 84*b* of the biasing portion 84 and the contact parts 85*b* of the biasing portion 85 is smaller than the width of the ink jet head 70 in the direction 70*b*. When the contact parts 85*b* of the biasing portion 85 contact the planar portion 76 of the ink jet head 70, the biasing portion 85 deforms toward one end side in the direction 80*b* away from the biasing portion 84 in the direction 80*b*. Then, the elastic force of the biasing portion 85, in an attempt to undo the deformation, serves to bias the planar portion 76 of the ink jet head 70 toward the other end side in the direction 80*b*. The reinforcing part 85*c* serves to prevent that the portion in the direction 80*c* where the three contact parts 85*b* are formed from deforming in the direction 80*b*.

A method for assembling the structural parts of the ink discharge unit 42 is hereinafter described.

Figure 8A:
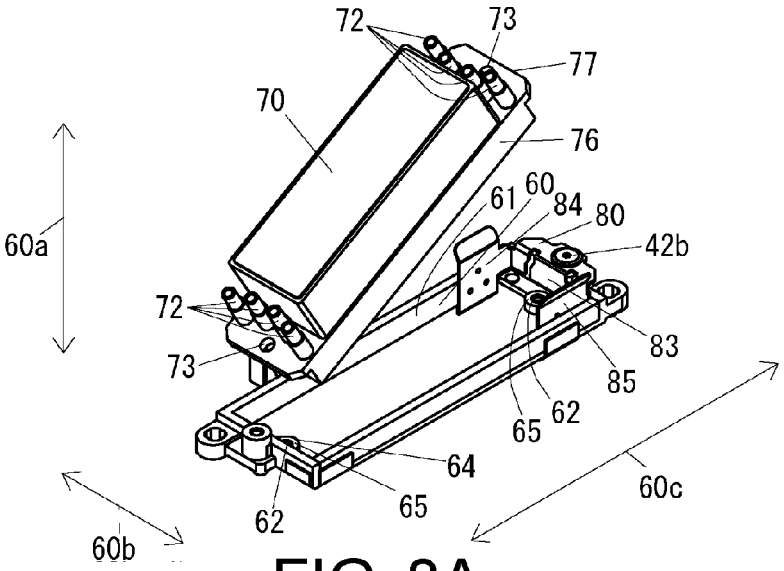
FIG. 8A is a front, upper-right perspective view of the external appearances of the fixing member, ink jet head, and biasing member illustrated in FIGS. 2A and 2B at a point in time during ink discharge unit assembling steps.
Figure 8B:
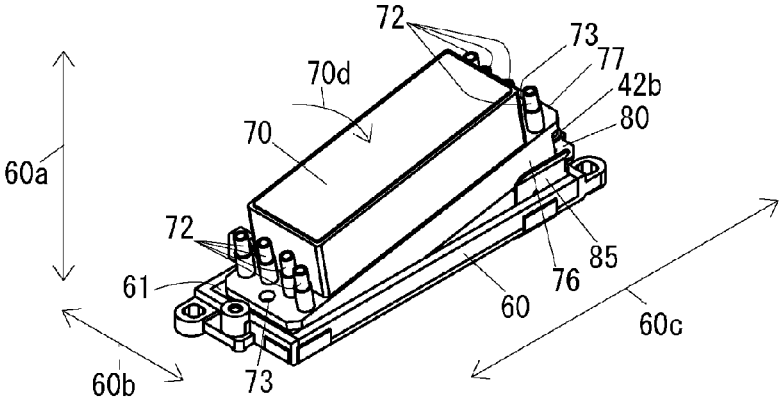
FIG. 8B is a front, upper-right perspective view of the external appearances of the fixing member, ink jet head, and biasing member at a point in time later than the point in time in FIG. 8A during the ink discharge unit assembling steps.
Figure 8C:
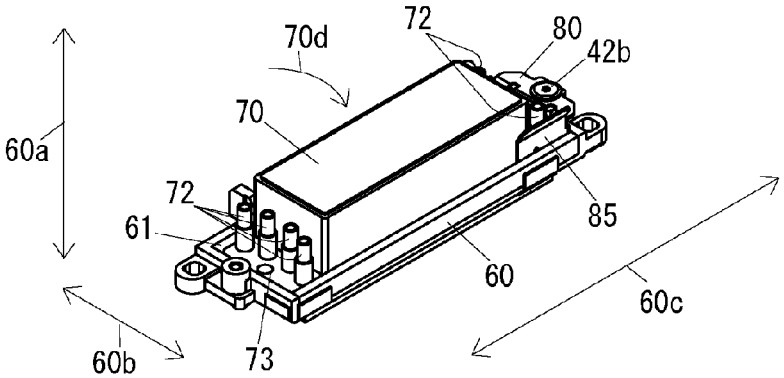
FIG. 8C is a front, upper-right perspective view of the external appearances of the fixing member, ink jet head, and biasing member at a point in time later than the point in time in FIG. 8B during the ink discharge unit assembling steps.

FIG. 8A is a front, upper-right perspective view of the external appearances of the fixing member 60, ink jet head 70, and biasing member 80 at a point in time during the steps of assembling the structural parts of the ink discharge unit 42. FIG. 8B is a front, upper-right perspective view of the external appearances of the fixing member 60, ink jet head 70, and biasing member 80 at a point in time later than the point in time in FIG. 8A during the steps of assembling the structural parts of the ink discharge unit 42. FIG. 8C is a front, upper-right perspective view of the external appearances of the fixing member 60, ink jet head 70, and biasing member 80 at a point in time later than the point in time in FIG. 8B during the steps of assembling the structural parts of the ink discharge unit 42.

An operator fits the biasing member 80 to the fixing member 60 and then fixes the biasing member 80 using the bolt 42*b* to the fixing member 60.

Next, the operator moves the ink jet head 70 toward the cavity 61 of the fixing member 60 with the biasing member

80 fixed thereto, as illustrated in FIG. 8A. Then, the operator brings an end part of the ink jet head 70 where the curved portion 75 is disposed into contact with an end part of the fixing member 60 where the curved portion 64 is disposed, as illustrated in FIG. 8B, so as to locate the curved portion 64 of the fixing member 60 in a space formed by the curved portion 75 of the ink jet head 70 (see FIGS. 4A to 4C).

While keeping contact between the end part of the ink jet head 70 where the curved portion 75 is disposed and the end part of the fixing member 60 where the curved portion 64 is disposed, the operator rotates the ink jet head 70 in the direction of rotation 70*d* around an axis extending in the direction 60*b* through a position of contact between the end part of the ink jet head 70 where the curved portion 75 is disposed and the end part of the fixing member 60 where the curved portion 64 is disposed. By thus rotating the ink jet head 70, the operator brings the ink jet head 70 into contact with the biasing member 80, as illustrated in FIG. 8C, to let the biasing portions 83 to 85 of the biasing member 80 bias the ink jet head 70.

Figure 9A:
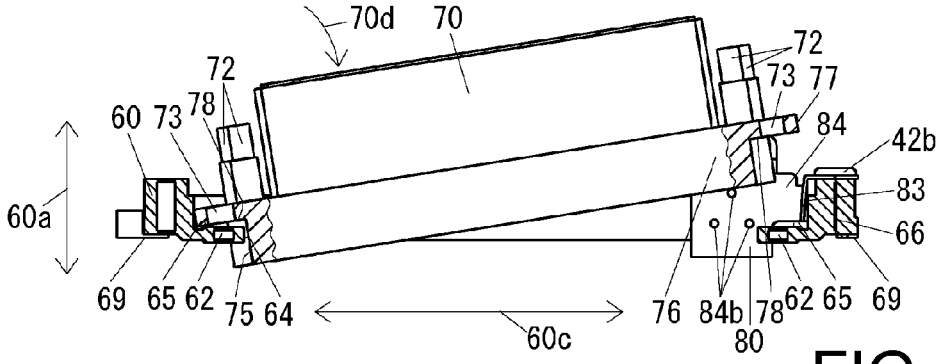
FIG. 9A is a partial right-side view in cross section of the fixing member, ink jet head, and biasing member illustrated in FIGS. 2A and 2B at a point in time during a step of bringing the ink jet head into contact with the biasing member.
Figure 9B:
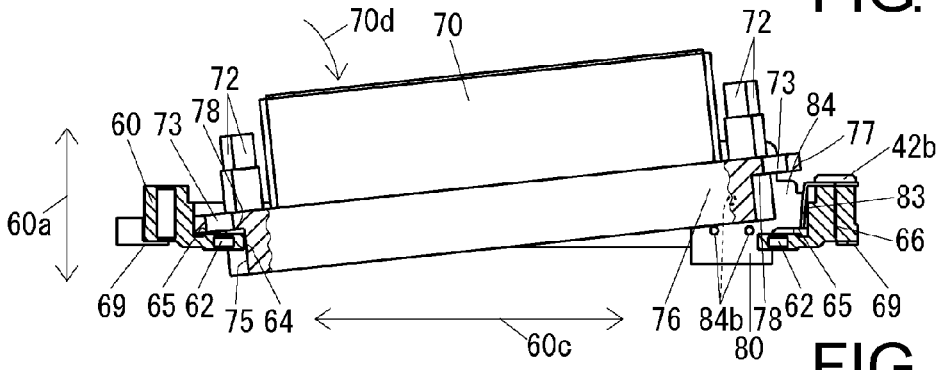
FIG. 9B is a partial right-side view in cross section of the fixing member, ink jet head, and biasing member at a point in time later than the point in time in FIG. 9A during the step of bringing the ink jet head into contact with the biasing member.
Figure 9C:
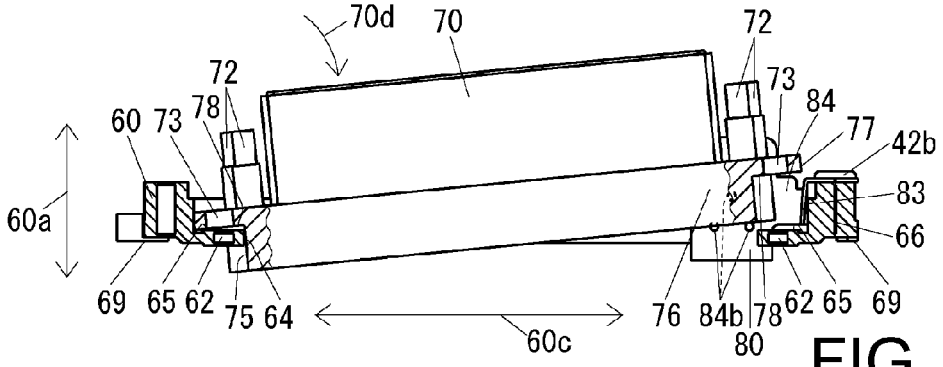
FIG. 9C is a partial right-side view in cross section of the fixing member, ink jet head, and biasing member at a point in time later than the point in time in FIG. 9B during the step of bringing the ink jet head into contact with the biasing member.
Figure 9D:
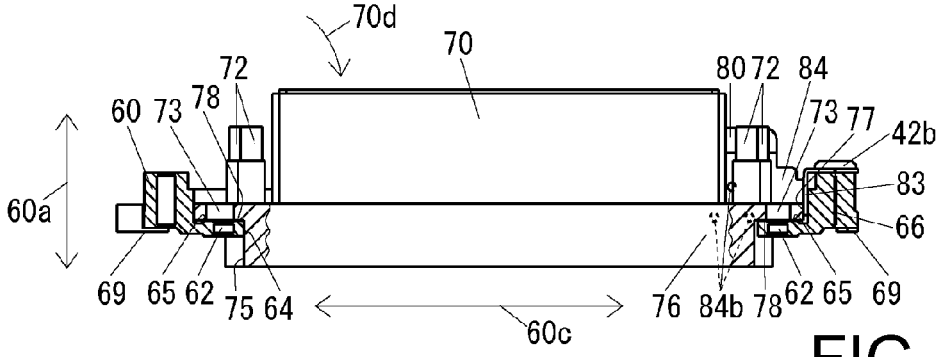
FIG. 9D is a partial right-side view in cross section of the fixing member, ink jet head, and biasing member at a point in time later than the point in time in FIG. 9C during the step of bringing the ink jet head into contact with the biasing member.

FIG. 9A is a partial right-side view in cross section of the fixing member 60, ink jet head 70, and biasing member 80 at a point in time during a step of bringing the ink jet head 70 into contact with the biasing member 80. FIG. 9B is a partial right-side view in cross section of the fixing member 60, ink jet head 70, and biasing member 80 at a point in time later than the point in time in FIG. 9A during the step of bringing the ink jet head 70 into contact with the biasing member 80. FIG. 9C is a partial right-side view in cross section of the fixing member 60, ink jet head 70, and biasing member 80 at a point in time later than the point in time in FIG. 9B during the step of bringing the ink jet head 70 into contact with the biasing member 80. FIG. 9D is a partial right-side view in cross section of the fixing member 60, ink jet head 70, and biasing member 80 at a point in time later than the point in time in FIG. 9C during the step of bringing the ink jet head 70 into contact with the biasing member 80.

The step of bringing the ink jet head 70 into contact with the biasing member 80, first, brings one of the two planar portions 76 into contact with the first one of the three contact parts 84*b* formed on the biasing portion 84 of the biasing member 80, as illustrated in FIG. 9A. Concurrently with the before-mentioned contact, the other one of the planar portions 76 of the ink jet head 70 similarly contacts the first one of the three contact parts 85*b* (see FIGS. 6A to 6C) formed on the biasing portion 85 of the biasing member 80 (see FIGS. 6A to 6C). This is, however, not illustrated in the drawings. The ink jet head 70, in the absence of the biasing member 80 in its part where the curved portion 75 is disposed, contacts the first ones of the contact parts 84*b* and 85*b* of the biasing member 80 on the opposite side of the curved portion 75. The ink jet head 70 is accordingly inclined relative to the fixing member 60 in the direction of rotation centered on the axis extending in the direction 60*b* (see FIGS. 8A to 8C), as illustrated in FIG. 9A. The operator may accordingly be allowed to easily rotate the ink jet head 70 in the direction of rotation 70*d* centered on the axis extending in the direction 60*b*.

As illustrated in FIG. 9A, these contacts with the first ones of the contact parts 84*b* and 85*b* may make it difficult for the part of the ink jet head 70 on the opposite side of the curved portion 75 in the direction 60*c* to move in the direction 60*b* and in the direction of rotation centered on an axis extending in the direction 60*a*. Hence, the operator may be allowed to reliably rotate the ink jet head 70 in the direction of rotation 70*d*.

Then, one of the two planar portions 76 of the ink jet head 70 contacts the second one of the three contact parts 84*b* formed on the biasing portion 84 of the biasing member 80, as illustrated in FIG. 9B. Concurrently with the before-mentioned contact, the other one of the planar portions 76 of the ink jet head 70 similarly contacts the second one of the three contact parts 85*b* founed on the biasing portion 85 of the biasing member 80. This is, however, not illustrated in the drawings. The contacts with two of the contact parts 84*b* and two of the contact parts 85*b* may make it more difficult for the part of the inkjet head 70 on the opposite side of the curved portion 75 in the direction 60*c* to move in the direction 60*b* and in the direction of rotation centered on the axis extending in the direction 60*a*. The second one of the contact parts 84*b* is less spaced from the center of rotation in the direction of rotation 70*d* than the first one of the contact parts 84*b*. As compared to the first one of the contact parts 84*b*, therefore, the second one of the contact parts 84*b* may more powerfully prevent the part of the inkjet head 70 on the opposite side of the curved portion 75 in the direction 60*c* from moving in the direction 60*b* and in the direction of rotation centered on the axis extending in the direction 60*a*. The description given so far to the contact parts 84*b* applies to the contact parts 85*b*. The operator may accordingly be allowed to further reliably rotate the inkjet head 70 in the direction of rotation 70*d*.

Then, one of the two planar portions 76 of the inkjet head 70 contacts the third one of the three contact parts 84*b* formed on the biasing portion 84 of the biasing member 80, as illustrated in FIG. 9C. Concurrently with the before-mentioned contact, the other one of the planar portions 76 of the ink jet head 70 similarly contacts the third one of the three contact parts 85*b* formed on the biasing portion 85 of the biasing member 80. This is, however, not illustrated in the drawings. The contacts with all of the three contact parts 84*b* and 85*b* may make it even more difficult for the part of the ink jet head 70 on the opposite side of the curved portion 75 in the direction 60*c* to move in the direction 60*b* and in the direction of rotation centered on the axis extending in the direction 60*a*. The operator may accordingly be allowed to even further reliably rotate the ink jet head 70 in the direction of rotation 70*d*.

Then, the planar portion 77 of the ink jet head 70 contacts the biasing portion 83 of the biasing member 80. The contact with the biasing portion 83 may make it difficult for the part of the ink jet head 70 on the opposite side of the curved portion 75 in the direction 60*c* to move in the direction 60*c* and in the direction of rotation centered on the axis extending in the direction 60*a*. The operator may accordingly be allowed to even further reliably rotate the ink jet head 70 in the direction of rotation 70*d*.

As illustrated in FIG. 9D, the planar portion 78 of the ink jet head 70 contacts the planar portion 65 of the fixing member 60. By having the ink jet head 70 be biased by the biasing portions 83 to 85 of the biasing member 80 as illustrated in FIG. 9D, the part of the ink jet head 70 on the opposite side of the curved portion 75 in the direction 60*c* is biased by the biasing member 80 and thereby positionally aligned relative to the fixing member 60 at positions in the directions 60*b* and 60*c* and in the direction of rotation centered on the axis extending in the direction 60*a*. As thus far described, the ink jet head 70 is finally fitted to the fixing member 60.

In the state illustrated in FIG. 9D, neither of the first one of the contact parts 84*b* nor the first one of the contact parts 85*b* contacts the ink jet head 70.

Figure 10:
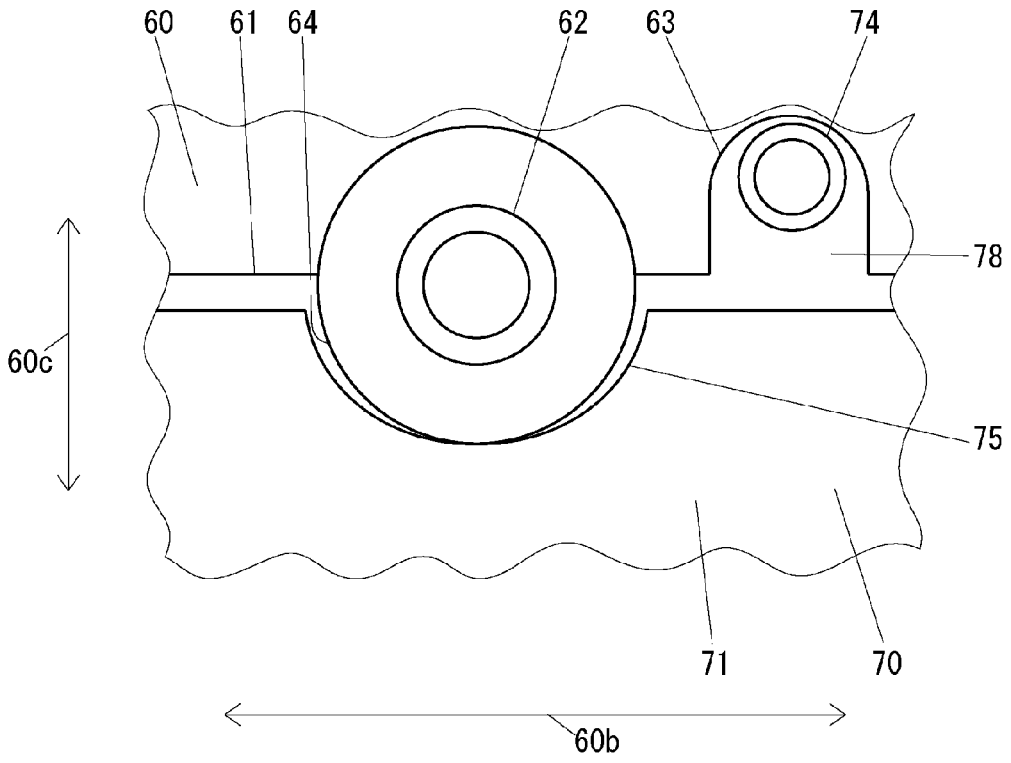
FIG. 10 is a bottom-side view of a region in vicinity of a curved portion of the ink jet head and a curved portion of the fixing member illustrated in FIGS. 2A and 2B while the ink jet head is being biased by biasing portions of the biasing member.

FIG. 10 is a bottom-side view of a region in vicinity of the curved portion 75 of the ink jet head 70 and the curved portion 64 of the fixing member 60 while the ink jet head 70 is being biased by the biasing portions 83 to 85 (see FIGS. 8A to 8C) of the biasing member 80 (see FIGS. 8A to 8C).

While the ink jet head 70 is being biased by the biasing portions 83 to 85 of the biasing member 80, the curved portion 64 of the fixing member 60 regulates movements of the ink jet head 70 in the directions 60*b* and 60*c* by way of contact with the curved portion 75 of the ink jet head 70, as illustrated in FIG. 10.

While the ink jet head 70 is being biased by the biasing portions 83 to 85 of the biasing member 80, the operator fixes the ink jet head 70 biased by the biasing member 80 to the fixing member 60 using the bolts 42*a*, as illustrated in FIG. 2A.

Next is described how the fixing member 60 with the ink jet head 70 immovably fitted thereto should be fixed to the carriage body 51.

The operator moves the fixing member 60 with the ink jet head 70 fixed thereto toward the cavity 51*a* of the carriage body 51, as illustrated in FIG. 2A, and then inserts the part of the ink jet head 70 including its nozzle surface 71 in the cavity 51*a* of the carriage body 51.

The operator then performs position alignment of the ink jet head 70 in the ink jet printer 10. Specifically, the operator positionally aligns the ink jet head 70 relative to the recording medium 90 supported by the platen 43 of the ink jet printer 10. The operator, by having the inks be discharged on the recording medium 90 through the nozzles 71*a* on the nozzle arrays 71*b* of the ink jet head 70, prints line segments corresponding to the nozzle arrays 71*a* on the recording medium 90. In connection with the line segments printed on the recording medium 90, the operator performs, on the carriage body 51, the position alignment of the ink jet head 70 in the ink jet printer 10 in the direction of rotation centered on an axis extending in the direction 10*a*, so that the angle of the direction of rotation centered on the axis extending in the direction 10*a* is adjusted to a target angle. In consequence of that, the ink jet head 70 is correctly positioned relative to the carriage body 51 in the direction of rotation centered on the axis extending in the direction 10*a*. In connection with the line segments printed on the recording medium 90, the operator performs, on the carriage body 51, the position alignment of the ink jet head 70 in the ink jet printer 10 in the direction 10*b*, so that the positions of the line segments in the direction 10*b* are adjusted to target positions. In consequence of that, the ink jet head 70 is correctly positioned relative to the carriage body 51 in the direction 10*b*. In connection with the line segments printed on the recording medium 90, the operator performs, on the carriage body 51, the position alignment of the ink jet head 70 in the ink jet printer 10 in the direction 10*c*, so that the positions of the line segments in the direction 10*c* are adjusted to target positions. In consequence of that, the ink jet head 70 is correctly positioned relative to the carriage body 51 in the direction 10*c*. In case a plurality of ink jet heads 70 are to be mounted in the carriage body 51, it is necessary to align the positions of the ink jet heads 70 relative to the other ink jet heads 70 mounted in the carriage body 51, in addition to aligning their positions in the ink jet printer 10.

To assemble the structural parts of the ink discharge unit 42, the operator fixes fixing member 60, to which the ink jet head 70 correctly positioned relative to the carriage body 51 is fixed, to the carriage body 51 using the bolts 52, as illustrated in FIG. 2B.

Next is described how the ink jet head 70 should be fitted to the fixing member 60 after the fixing member 60 is fixed to the carriage body 51.

In the event of missing dots (hereinafter, missing nozzle) in any part of an image printed by the ink jet printer 10 or clogging of the nozzles 71*a* of the ink jet head 70 (hereinafter, "nozzle clogging"), image quality degradation and/or printing position errors may occur. The operator, who recognized any missing nozzle and/or nozzle clogging, performs maintenances of the ink jet head 70 in various manners to solve these problems. The maintenances are normally performed to solve such problems in the ink jet printer 10 mounted with the ink jet head 70. However, if any maintenance carried out in the ink jet printer 10 mounted with the ink jet head 70 is unsuccessful, failing to solve the problems of missing nozzle and/or nozzle clogging, the operator may be required to perform a maintenance of the ink jet printer 10 from which the ink jet head 70 has been removed. In that case, the operator needs to remount the ink jet head 70 in the ink jet printer 10 or to mount a new ink jet head 70 that replaces the removed ink jet head 70 in the ink jet printer 10 when the maintenance is over.

The operator unfastens the bolts 42*a* on the fixing member 60 still fixed to the carriage body 51 and then removes the ink jet head 70 from the fixing member 60 in the reversed order of the assembling steps illustrated in FIGS. 8A and 9D.

After the ink jet head 70 removed from the fixing member 60 or a new ink jet head 70 for replacement is fitted to the fixing member 60 after a performed maintenance, the operator brings the end part of the ink jet head 70 where the curved portion 75 is disposed into contact with the end part of the fixing member 60 where the curved portion 64 is disposed. The operator, while keeping the contact, rotates the ink jet head 70 in the direction of rotation 70*d*. The operator thereby brings the ink jet head 70 into contact with the biasing member 80 in the same manner as illustrated in FIGS. 8A and 9D to have the ink jet head 70 be biased by the biasing portions 83 to 85 of the biasing member 80. Thus, the part of the ink jet head 70 on the opposite side of the curved portion 75 in the direction 10*c* is aligned relative to the fixing member 60 by being biased by the biasing member 80 at positions in the directions 10*b* and 10*c* and in the direction of rotation centered on the axis extending in the direction 10*a*. Further, the curved portion 64 of the fixing member 60 regulates movements of the ink jet head 70 in the directions 10*b* and 10*c* by way of contact with the curved portion 75 of the ink jet head 70. Therefore, the position of the ink jet head 70 relative to the carriage body 51 remounted in the ink jet printer 10 coincides with the position of the ink jet head 70 relative to the carriage body 51 yet to be dismounted from the ink jet printer 10.

After the ink jet head 70 is fitted to the fixing member 60 and biased by the biasing member 80, the operator finally fixes the ink jet head 70 to the fixing member 60 using the bolts 42*a* to complete the assembling of the ink discharge unit 42.

As thus far described, the ink discharge unit 42 is structured to positionally locate the ink jet head 70 by lever aging the biasing force of the biasing member 80, instead of an operator manually supporting the position of the ink jet head 70 relative to the fixing member 60. This may allow the ink jet head 70 to be very accurately positioned relative to the fixing member 60.

The ink discharge unit 42 is specifically structured to bias the ink jet head 70 in the directions 10*b* and 10*c* using the biasing member 80 for position alignment of the ink jet head 70 relative to the fixing member 60 and to regulate movements of the ink jet head 70 in the directions 10*b* and 10*c* using the curved portion 64 of the fixing member 60. This may ensure high accuracy in positioning the ink jet head 70 relative to the fixing member 60.

When the centers of adjacent ink dots formed on the recording medium 90 by the ink jet printer 10 are spaced from each other by a distance of 10 μm to 50 μm, the position of the ink jet head 70 relative to the carriage body 51 is preferably reproducible within errors of 5 μm to 20 μm for a satisfactory printing quality of the ink jet printer 10.

The ink discharge unit 42 is thus structured to push the ink jet head 70 in a direction included in the direction 10*c* using the biasing portion 83 of the biasing member 80 and to hold the ink jet head 70 between the biasing portions 84 and 85 of the biasing member 80 by biasing the ink jet head 70 in two directions included in the direction 10*b* using these biasing portions. In the ink discharge unit 42, the position of the ink jet head 70 may be better supported relative to the fixing member 60 by the biasing force of the biasing member 80. The ink discharge unit 42, therefore, may further improve the positioning accuracy of the ink jet head 70 relative to the fixing member 60 at the time of fixing the ink jet head 70 to the fixing member 60.

The ink discharge unit 42 may be structured to bias the ink jet head 70 using the biasing member 80 in two directions alone.

In the ink discharge unit 42, the ink jet head 70, with its position relative to the fixing member 60 being supported by the biasing force of the biasing member 80, is fitted to the fixing member 60. At the time of fitting the ink jet head 70 to the fixing member 60, therefore, an operator's handwork is unnecessary to support the position of the ink jet head 70 relative to the fixing member 60, facilitating the assembling work as compared to the conventional techniques.

In the embodiment, the unit assembling method for assembling the structural parts of the ink discharge unit 42, after the ink jet head 70 is fitted to the fixing member 60, positionally aligns the ink jet head 70 relative to the carriage body 51 and then fixes the fixing member 60 to the carriage body 51. In case the ink jet head 70 is removed from the fixing member 60 after the fixing member 60 with the ink jet head 70 fitted thereto is fixed to the carriage body 51 and a new ink jet head 70 is then fitted to the fixing member 60, the ink jet head 70 newly fitted to the fixing member 60 may be very accurately positioned by the biasing member 80 relative to the carriage body 51. When the ink jet head 70 once removed from the carriage body 51 is fitted back to the carriage body 51, the unit assembling method according to this embodiment may allow the ink jet head 70 to be very accurately positioned relative to the carriage body 51. Further, the unit assembling method may facilitate and accelerate the assembling work as compared to the conventional techniques.

Thus accelerating the step of fitting the removed ink jet head 70 back to the carriage body 51 may reduce downtime of the ink jet printer 10 between the removal and the refitting of the ink jet head 70 from and to the carriage body 51. The ink jet printer 10 with the benefit of less ink consumption is particularly useful in a broad range of industrial applications. Reduced downtime of the ink jet printer 10, therefore, may lead to improvements in productivity of printed matters.

Facilitating and accelerating the step of fitting the removed ink jet head 70 back to the carriage body 51 may lighten an operator's work burden and reduce working costs.

The advantages such as reduced down time of the ink jet printer 10, lightened operators' work burden, and reduced working costs, may be good incentives that motivate an operator to perform maintenances that require the removal and/or replacement of the ink jet head 70. Especially when the ink jet head 70 needs to be removed from the ink jet printer 10 for maintenances, an operator may be motivated to willingly perform maintenances that may promise high rates of recovery of the ink jet head 70, including treatments using specially designed tools or specially developed chemical solutions. By thus motivating an operator to perform maintenances that require the removal and replacement of the ink jet head 70, the ink jet printer 10 may be a useful production apparatus improved in reliability.

The ink discharge unit 42 thus guides the ink jet head 70 to a predetermined position in the fixing member 60 using the inclined part 84*a* of the biasing portion 84 and the inclined part 85*a* of the biasing portion 85 when the ink jet head 70 is moved to be biased by the biasing member 80. As a result, the ink jet head 70 may be manually positioned relative to the fixing member 60 more accurately and more easily.

In the ink discharge unit 42, the biasing portion 83 is disposed in the biasing member 80 at a position where the biasing portion 83 contacts the ink jet head 70 later than the biasing portions 84 and 85 when the ink jet head 70 to be fitted to the fixing member 60 is brought into contact with the biasing member 80 fixed to the fixing member 60, as illustrated in FIGS. 9A to 9D. When the ink jet head 70 is moved to be biased by the biasing member 80 in the ink discharge unit 42, the ink jet head 70 is biased by the biasing portions 84 and 85 of the biasing member 80 in two directions included in the direction 60*b* (see FIGS. 8A to 8C), i.e., in opposite directions included in the direction 60*b*, and then biased by the biasing portion 83 of the biasing member 80 in the direction 60*c*. Thus, the biasing force of the biasing member 80 can be applied in stages to the ink jet head 70 in accordance with the movement of the ink jet head 70. Therefore, the ink discharge unit 42 may effectively facilitate the manual assembling work.

When the ink jet head 70 is moved to be biased by the biasing member 80 in the ink discharge unit 42, as illustrated in FIGS. 9A to 9C, the biasing force can be applied in stages to the ink jet head 70 by the three contact parts 84*b* formed on the biasing portion 84 of the biasing member 80 in accordance with the movement of the ink jet head 70. The description given so far to the three contact parts 84*b* of the biasing portion 84 of the biasing member 80 applies to the three contact parts 85*b* of the biasing portion 85 of the biasing member 80. Therefore, the ink discharge unit 42 may effectively facilitate the manual assembling work.

The structure of the biasing member 80 is not limited to the structure described in this embodiment but may include any resilient structures that can flexibly deal with variability in shapes and/or dimensions of the ink jet head 70 and the fixing member 60.

Figure 11:
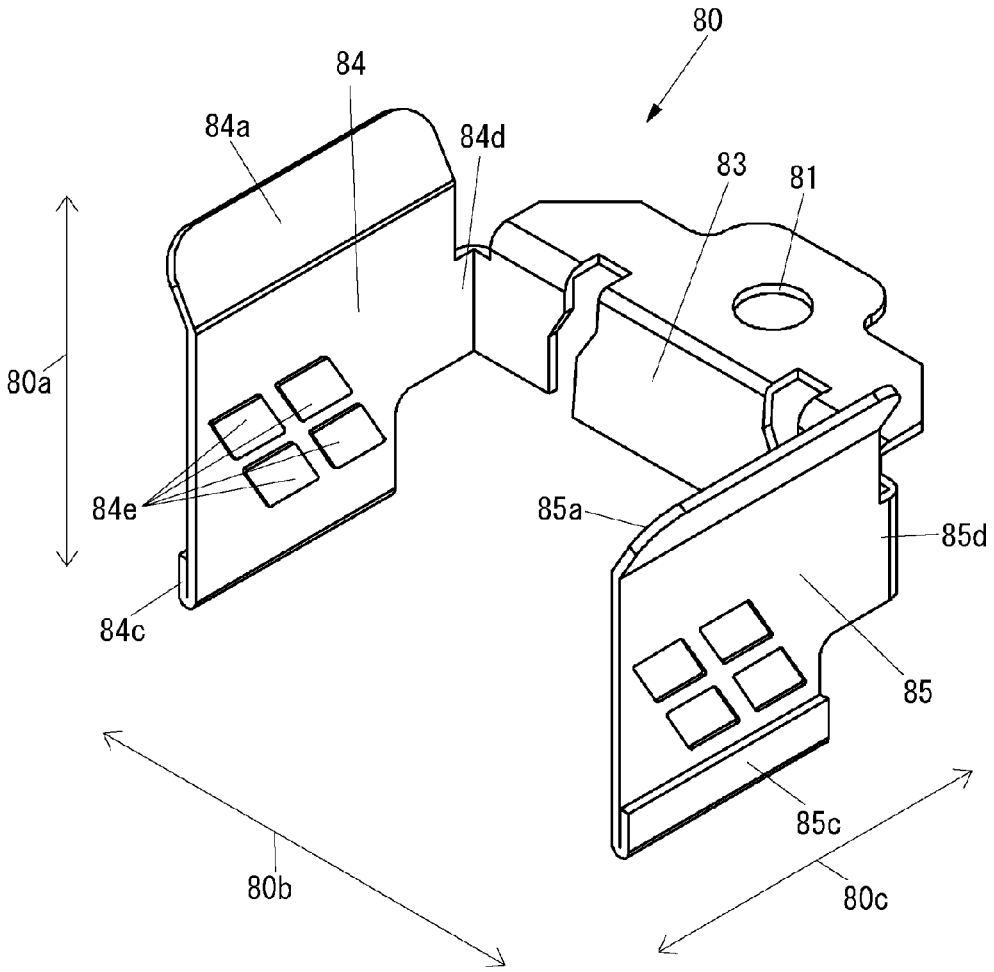
FIG. 11 is a front, upper-right perspective view of the external appearance of an example of the biasing member different from the biasing member illustrated in FIG. 7.

For instance, the biasing member 80 may have four rhombic contact parts 84*e* on the biasing portion 84, instead of the three point-like contact parts 84*b*, as illustrated in FIG. 11. The contact parts 84*e* protrude toward the biasing portion 85. The contact parts 84*e* each contact the ink jet head 70 in a larger area than the contact part 84*b*. When the planar portion 76 of the ink jet head 70 moves in contact with these contact parts, the planar portion 76 may accordingly be damaged in a larger area. Due to the fact that a larger contact area delivers a smaller contact pressure, however, any damage on the planar portion 76 of the ink jet head 70 may be reduced in depth. The modified example of the biasing portion 84 described above applies to the biasing portion 85.

Figure 12:
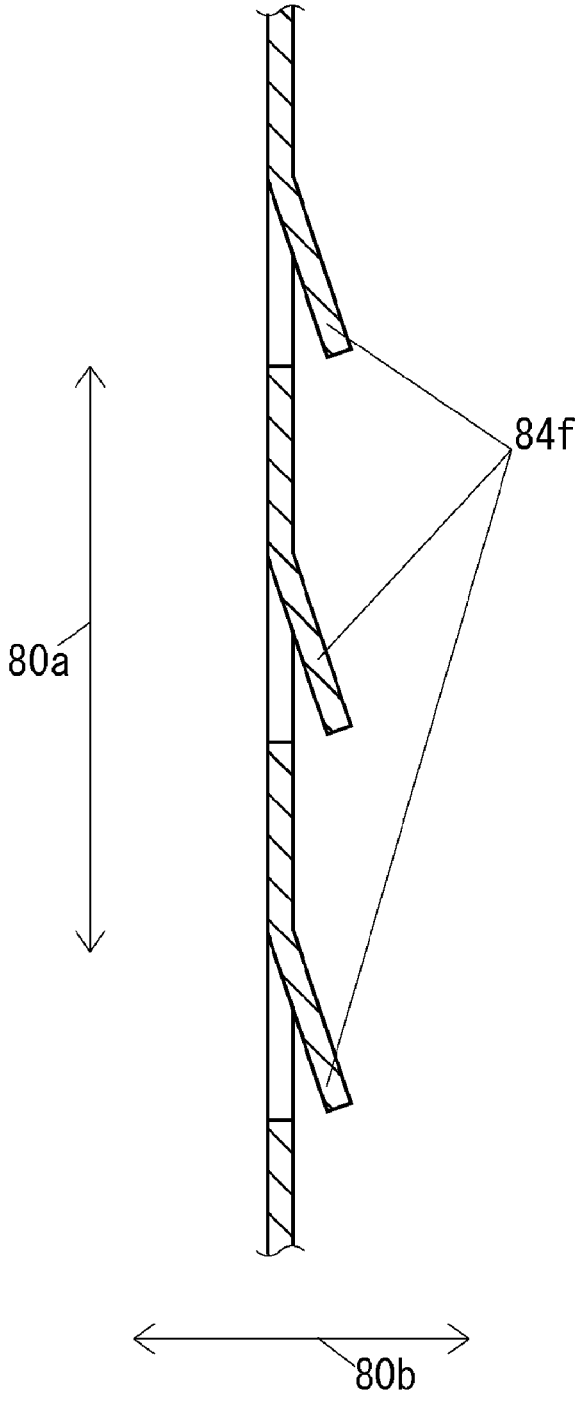
FIG. 12 is a partial view in cross section of another example of the biasing member different from the biasing members illustrated in FIGS. 7 and 11.

The biasing member 80, instead of the three point-like contact parts 84*b*, may have contact parts 84*f* in the biasing portion 84. As illustrated in FIG. 12, the contact parts 84*f* are formed by cutting parts of the biasing member 80 so as to rise upward. The contact parts thus formed generate an elastic force. The contact parts 84*f* protrude toward the biasing portion 85. The modified example of the biasing portion 84 described above applies to the biasing portion 85.

In the ink discharge unit 42, the convex surface of the curved portion 64 of the fixing member 60 has a larger curvature than the concave surface of the curved portion 75 of the ink jet head 70. The convex surface of the curved portion 64 of the fixing member 60 thus greater in curvature may certainly be brought into close contact with the concave surface of the curved portion 75 of the ink jet head 70. In the ink discharge unit 42, the movements of the ink jet head 70 in the direction 10*b* and 10*c* may be regulated by the fixing member 60 by way of such a simplified structure.

In this embodiment, the curved portion 75 of the ink jet head 70 has a concave surface, whereas the curved portion 64 of the fixing member 60 has a convex surface. Instead, the curved portion 75 of the ink jet head 70 may have a convex surface, and the curved portion 64 of the fixing member 60 may have a concave surface.

In this embodiment, the biasing direction of the ink jet head by the biasing member includes two directions orthogonal to each other. The biasing direction of the ink jet head by the biasing member may not necessarily include two directions orthogonal to each other. For instance, the biasing direction of the ink jet head by the biasing member may be one direction orthogonal to the ink-discharge direction of the ink jet head mounted in the carriage 50, or may include two directions orthogonal to the ink-discharge direction of the ink jet head mounted in the carriage 50. The latter two directions are not orthogonal to each other but intersect each other.

In this embodiment, the biasing member 80 is fixed to the fixing member 60 with the bolt 42*b*. The biasing member 80, instead of being bolt-fixed to the fixing member 60, may be simply attached to the fixing member 60. Fixing the biasing member 80 to the fixing member 60 using the bolt 42*b* may allow the biasing member 80 to be very accurately positioned relative to the fixing member 60. At the time of fitting the ink jet head 70 to the fixing member 60, therefore, the ink jet head 70 may be very accurately positioned relative to the fixing member 60 by the biasing member 80.

In the ink discharge unit 42, the carriage body 51 and the fixing member 60 to which the ink jet head 70 is fitted are different members separately provided. Therefore, the ink jet head 70 may be very accurately positioned relative to the carriage body 51 by adjusting the position of the fixing member 60 relative to the carriage body 51.

In the ink discharge unit 42, the ink jet head 70 and the biasing member 80 may be directly fitted to the carriage body 51, i.e., carriage 50, instead of using the fixing member 60.

What is claimed is:

1. An ink discharge unit, comprising:

an inkjet head that discharges an ink toward a recording medium;

a carriage that moves relative to the recording medium; and a biasing member that biases the inkjet head mounted in the carriage for position alignment of the inkjet head relative to the carriage, the carriage comprising: a carriage-side contact portion that makes contact with the inkjet head in an orthogonal direction orthogonal to a direction in which the ink is discharged from the inkjet head mounted in the carriage, the inkjet head being biased by the biasing member in a pushing direction included in the orthogonal direction in which the inkjet head is pushed against the carriage-side contact portion, the carriage-side contact portion serving to regulate, by way of contact with the inkjet head, movements of the inkjet head in at least two directions that includes the pushing direction included in the orthogonal direction;

the biasing member comprises:

a pushing direction biasing portion that biases the inkjet head in the pushing direction; and a different direction biasing portion that biases the inkjet head in at least a direction included in the orthogonal direction other than the pushing direction, and an axis direction of the direction included in the orthogonal direction is different from an axis direction of the pushing direction.

2. The ink discharge unit according to claim 1, wherein the different direction biasing portion comprises: a first biasing portion and a second biasing portion disposed at opposing positions, the first biasing portion and second biasing portion bias the inkjet head toward each other to hold the inkjet head therebetween, and the first biasing portion and second biasing portion bias the inkjet head in a direction included in the orthogonal direction and orthogonal to the pushing direction.

3. The ink discharge unit according to claim 2, wherein the first biasing portion and the second biasing portions each have a guiding member, and the guiding members, while holding the inkjet head therebetween, guide the inkjet head to a predetermined position in the carriage.

4. The ink discharge unit according to claim 1, wherein the inkjet head comprises: a head-side contact portion that makes contact with the carriage-side contact portion in the orthogonal direction, one of the carriage-side contact portion and the head-side contact portion has a convex surface, the other one of the carriage-side contact portion and the head-side contact portion has a concave surface, and the convex surface has a greater curvature than the concave surface.

5. The ink discharge unit according to claim 1, wherein a plurality of the inkjet heads is arranged on the carriage, and each of the plurality of inkjet heads is provided with the biasing member.

6. An ink discharge unit, comprising:

an inkjet head that discharges an ink toward a recording medium;

a carriage that moves relative to the recording medium; and a biasing member that biases the inkjet head mounted in the carriage for position alignment of the inkjet head relative to the carriage, the carriage comprising: a carriage-side contact portion that makes contact with the inkjet head in an orthogonal direction orthogonal to a direction in which the ink is discharged from the inkjet head mounted in the carriage, the inkjet head being biased by the biasing member in a pushing direction included in the orthogonal direction in which the inkjet head is pushed against the carriage-side contact portion, the carriage-side contact portion serving to regulate, by way of contact with the inkjet head, movements of the inkjet head in at least two directions that includes the pushing direction included in the orthogonal direction, wherein the carriage comprises:

a body; and a fixing member fixable to the body, the biasing member, while being fitted to the fixing member, biases the inkjet head for position alignment of the inkjet head relative to the fixing member, and the carriage-side contact portion is disposed in the fixing member.

7. The ink discharge unit according to claim 6, wherein the biasing member comprises:

a pushing direction biasing portion that biases the inkjet head in the pushing direction; and a different direction biasing portion that biases the inkjet head in at least a direction included in the orthogonal direction other than the pushing direction.

8. The ink discharge unit according to claim 7, wherein the different direction biasing portion comprises: a first biasing portion and a second biasing portion disposed at opposing positions, the first biasing portion and second biasing portion bias the inkjet head toward each other to hold the inkjet head therebetween, and the first biasing portion and second biasing portion bias the inkjet head in a direction included in the orthogonal direction and orthogonal to the pushing direction.

9. The ink discharge unit according to claim 8, wherein the first biasing portion and the second biasing portions each have a guiding member, and the guiding members, while holding the inkjet head therebetween, guide the inkjet head to a predetermined position in the carriage.

10. A unit assembling method for assembling an ink discharge unit, and the ink discharge unit comprising:

an inkjet head that discharges an ink toward a recording medium;

a carriage that moves relative to the recording medium, and the carriage comprises: a body; and a fixing member fixable to the body; and a biasing member that, while being fitted to the fixing member, biases the inkjet head for position alignment of the inkjet head relative to the fixing member, wherein the unit assembling method comprising:

fitting the inkjet head to the fixing member while the inkjet head is being biased by the biasing member fitted to the fixing member; and performing subsequently position alignment of the inkjet head relative to the body, thereafter, the fixing member being fixed to the body while the inkjet head is being positionally aligned relative to the body.

11. The unit assembling method according to claim 10, wherein the inkjet head removed from the fixing member fixed to the body is refitted to the fixing member, while the inkjet head is being biased by the biasing member fitted to the fixing member.

* * * * *